US010049836B1

(12) United States Patent
Patwardhan et al.

(10) Patent No.: US 10,049,836 B1
(45) Date of Patent: Aug. 14, 2018

(54) ELECTRICAL ENCLOSURE, AND SWITCHING ASSEMBLY AND TRANSFER ASSEMBLY THEREFOR

(71) Applicant: EATON CORPORATION, Cleveland, OH (US)

(72) Inventors: Sujit Subhash Patwardhan, Maharashtra (IN); Ramesh Shivaji Powar, Maharashtra (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/430,612

(22) Filed: Feb. 13, 2017

(51) Int. Cl.

| | |
|---|---|
| ***H01H 3/20*** | (2006.01) |
| ***H01H 17/00*** | (2006.01) |
| ***H01H 21/36*** | (2006.01) |
| ***H01H 21/22*** | (2006.01) |

(52) U.S. Cl.
CPC ..... *H01H 21/36* (2013.01); *H01H 21/22* (2013.01)

(58) Field of Classification Search
CPC ..... H01H 71/00; H01H 71/02; H01H 71/10; H01H 71/52; H01H 71/521; H01H 73/00; H01H 73/02; H01H 73/06; H01H 73/10; H01H 2221/00; H01H 2221/016; H01H 2221/024; H01H 1/52; H01H 3/20; H01H 9/00; H01H 9/02; H01H 9/06; H01H 9/0264; H01H 9/20; H01H 19/00; H01H 19/02; H01H 19/04
USPC ... 200/318, 331, 19.18, 19.21, 19.27, 43.01, 200/43.14, 43.15, 43.16, 43.22
See application file for complete search history.

(56) References Cited

U.S. PATENT DOCUMENTS

| | | | | |
|---|---|---|---|---|
| 3,324,259 | A | 2/1966 | Chamberlin, Jr. et al. | |
| 3,260,808 | A | 7/1966 | Dimond et al. | |
| 5,493,083 | A * | 2/1996 | Olivier | H01H 9/22 200/17 R |
| 5,504,290 | A * | 4/1996 | Baginski | H01H 3/3031 200/330 |
| 6,518,526 | B2 | 2/2003 | Hamada et al. | |
| 6,969,813 | B1 | 11/2005 | Winslett et al. | |

* cited by examiner

*Primary Examiner* — Anthony R. Jimenez
(74) *Attorney, Agent, or Firm* — Eckert Seamans

(57) ABSTRACT

A transfer assembly is for a switching assembly mounted in an electrical enclosure. The switching assembly has an electrical switching apparatus, a shaft, and a handle member coupled to the shaft. The electrical switching apparatus is structured to move between an ON position and an OFF position. The transfer assembly includes a body structured to be coupled to the electrical switching apparatus, and a cam assembly structured to move between a FIRST position and a SECOND position. The cam assembly includes a rotary member coupled to the body and structured to be coupled to the shaft, and a driving member cooperable with the rotary member. When the cam assembly moves between the FIRST position and the SECOND position, the driving member drives the electrical switching apparatus between the ON position and the OFF position.

17 Claims, 4 Drawing Sheets

ELECTRICAL ENCLOSURE, AND SWITCHING ASSEMBLY AND TRANSFER ASSEMBLY THEREFOR

BACKGROUND

Field

The disclosed concept relates to electrical enclosures. The disclosed concept also relates to switching assemblies for electrical enclosures including, for example, electrical switching apparatus such as circuit breakers. The disclosed concept also relates to transfer assemblies for switching assemblies.

Background Information

Electrical enclosures commonly include electrical switching apparatus such as, for example, circuit switching devices; circuit interrupters such as circuit breakers; network protectors; contactors; motor starters; motor controllers; and other load controllers. Circuit breakers are used to protect electrical circuitry from damage due to an overcurrent condition, such as an overload condition or a relatively high level short circuit or fault condition. Small power switches are commonly referred to as miniature circuit breakers, and are used, for example, in residential and light commercial electrical distribution systems.

One known drawback of electrical enclosures including electrical switching apparatus pertains to accessibility. More specifically, in order for an operator to move the electrical switching apparatus between an ON position and an OFF position, the operator must remove a portion of the electrical enclosure to access the electrical switching apparatus. This may require the time consuming steps of, for example, opening a door of the electrical enclosure, moving the electrical switching apparatus between ON and OFF positions, and then closing the door.

There is thus room for improvement in electrical enclosures, and in switching assemblies and transfer assemblies therefor.

SUMMARY

These needs and others are met by embodiments of the disclosed concept, which are directed to an improved electrical enclosure, and switching assembly and transfer assembly therefor.

In accordance with one aspect of the disclosed concept, a transfer assembly is provided for a switching assembly of an electrical enclosure. The switching assembly has an electrical switching apparatus, a shaft, and a handle member coupled to the shaft. The electrical switching apparatus is structured to move between an ON position and an OFF position. The transfer assembly includes a body structured to be coupled to the electrical switching apparatus, and a cam assembly structured to move between a FIRST position and a SECOND position. The cam assembly includes a rotary member coupled to the body and structured to be coupled to the shaft, and a driving member cooperable with the rotary member. When the cam assembly moves between the FIRST position and the SECOND position, the driving member drives the electrical switching apparatus between the ON position and the OFF position.

In accordance with another aspect of the disclosed concept, a switching assembly is provided for an electrical enclosure. The switching assembly includes an electrical switching apparatus structured to move between an ON position and an OFF position, a shaft, a handle member coupled to the shaft, and the aforementioned transfer assembly.

In accordance with another aspect of the disclosed concept, an electrical enclosure is provided. The electrical enclosure includes a number of walls defining an enclosed region, and the aforementioned switching assembly mounted substantially inside the enclosed region.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the statement that two or more parts are "coupled" or "connected" together shall mean that the parts are joined together either directly or joined through one or more intermediate parts.

As employed herein, the term "number" shall mean one or an integer greater than one (i.e., a plurality).

As employed herein, the term "coupling member" refers to any suitable connecting or tightening mechanism expressly including, but not limited to, zip ties, wire ties, rivets, screws, bolts, the combination of bolts and nuts (e.g., without limitation, lock nuts), and washers and nuts.

As employed herein, the statement that two or more parts or components "engage" one another shall mean that the parts exert a force against one another either directly or through one or more intermediate parts or components.

Figure 1:
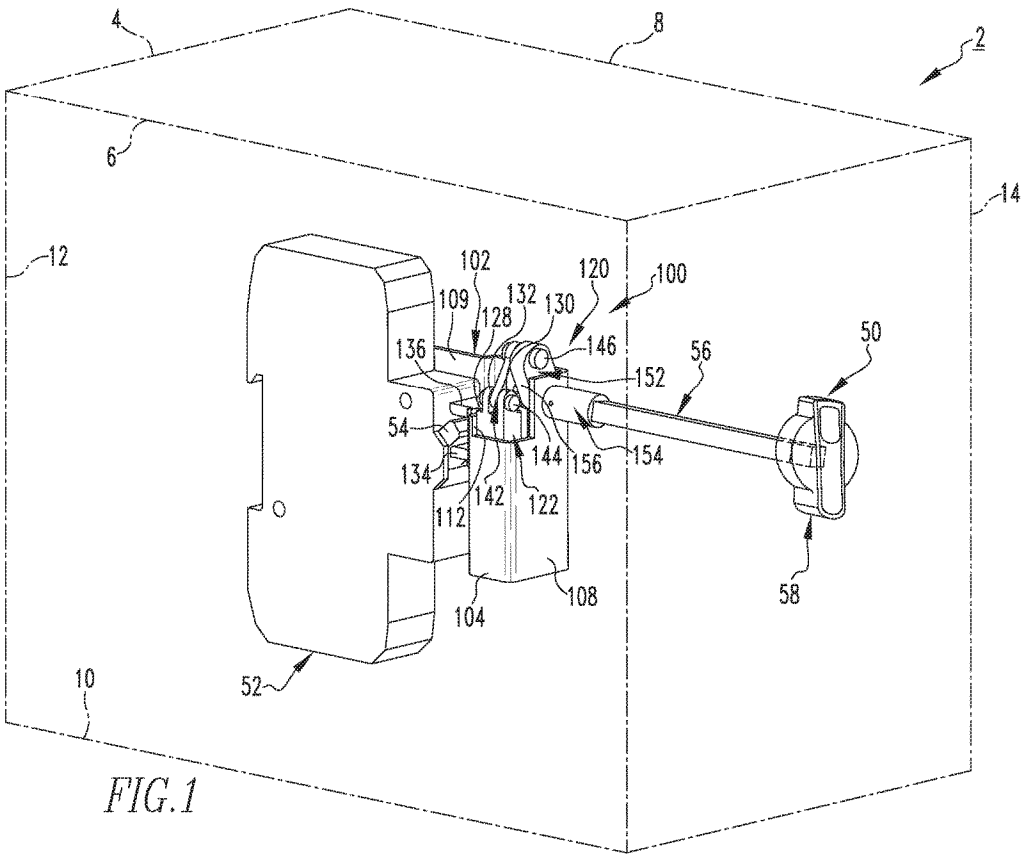
FIG. 1 is a simplified view of an electrical enclosure, and switching assembly and transfer assembly therefor, shown with the electrical switching apparatus in an ON position, in accordance with one non-limiting embodiment of the disclosed concept.

FIG. 1 is a simplified view of an electrical enclosure 2, in accordance with one non-limiting embodiment of the disclosed concept. The example electrical enclosure 2 includes a number of wall members 4,6,8,10,12,14 (shown in simplified form) and a switching assembly 50. The wall members 4,6,8,10,12,14 are joined together to define an enclosed region. The switching assembly 50 includes an electrical switching apparatus (e.g., without limitation, one-pole miniature circuit breaker 52), a shaft 56, a handle member 58, and a novel transfer assembly 100. The shaft 56 extends through the wall member 14 and is coupled to the handle member 58. As will be discussed in greater detail, the transfer assembly 100 provides a novel mechanism by which the circuit breaker 52 can be moved between an ON position and an OFF position from a location external the enclosed region defined by the wall members 4,6,8,10,12,14. As such, the disclosed concept advantageously eliminates the need for any of the wall members 4,6,8,10,12,14 to be moved and/or opened in order to operate the circuit breaker 52.

Continuing to refer to FIG. 1, the transfer assembly 100 includes a body 102, a cam assembly 120, and a cylindrical-shaped connector member 154. The cam assembly 120 includes a driving member 122, a link member 142, a number of coupling members 144,146, and a rotary member 152 cooperable with the driving member 122. The body 102, driving member 122, link member 142, and rotary member 152 may be made of any suitable material known in the art (e.g., without limitation, metal). As shown, the shaft 56 extends into and is coupled to the connector member 154. Accordingly, it will be appreciated that rotation of the handle member 58 (i.e., by an operator) causes rotation of the connector member 154.

Figure 2:
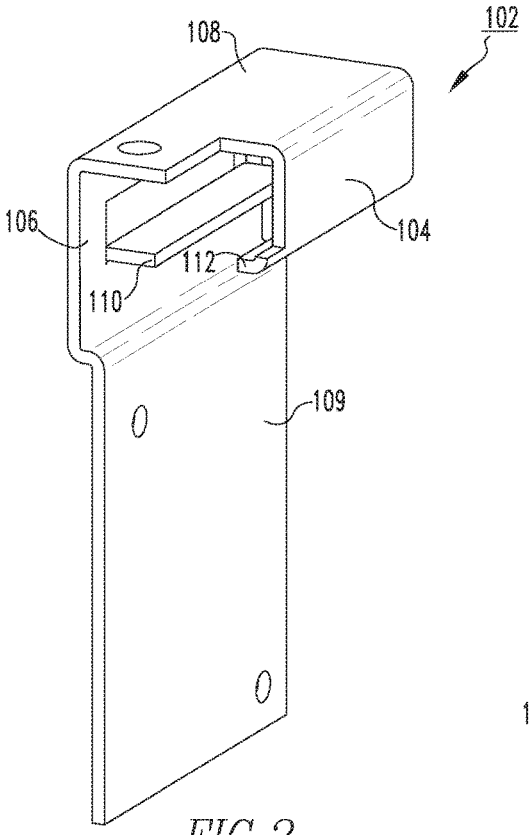
FIG. 2 and FIG. 3 are isometric views of a body for the transfer assembly of FIG. 1.
Figure 3:
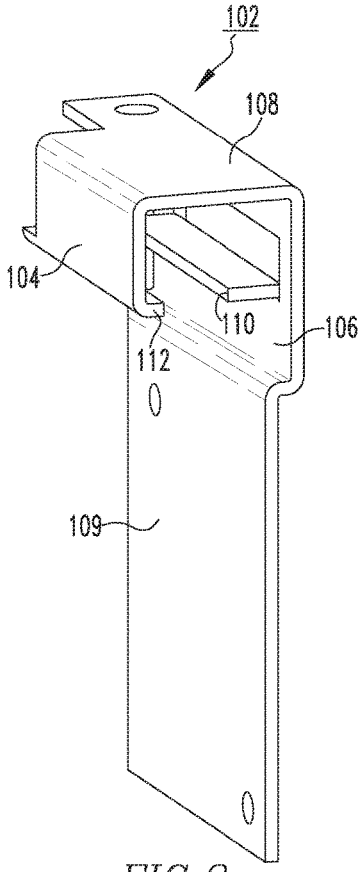

FIG. 2 and FIG. 3 show different views of the body 102. As shown, the body has parallel, opposing first and second walls 104,106, a third wall 108 connecting and being generally perpendicular to the first and second walls 104, 106, and a fourth wall 109 extending from and being offset with respect to the second wall 106. It will be appreciated that the fourth wall 109 is generally flush with and coupled to a surface of the circuit breaker 52 (FIG. 1) by a suitable number of coupling members (not shown in FIG. 1). Furthermore, as shown in FIG. 2 and FIG. 3, the body 102 has a first guide rail portion 110 extending from the second wall 106 toward the first wall 104, and a second guide rail portion 112 extending from the first wall 104 toward the second wall 106. The function of the guide rail portions 110,112 will be discussed below.

Figure 4:
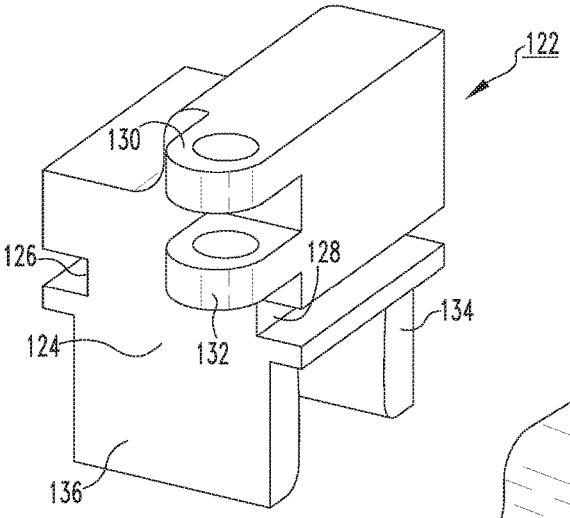
FIG. 4 and FIG. 5 are isometric views of a driving member for the transfer assembly of FIG. 1.
Figure 5:
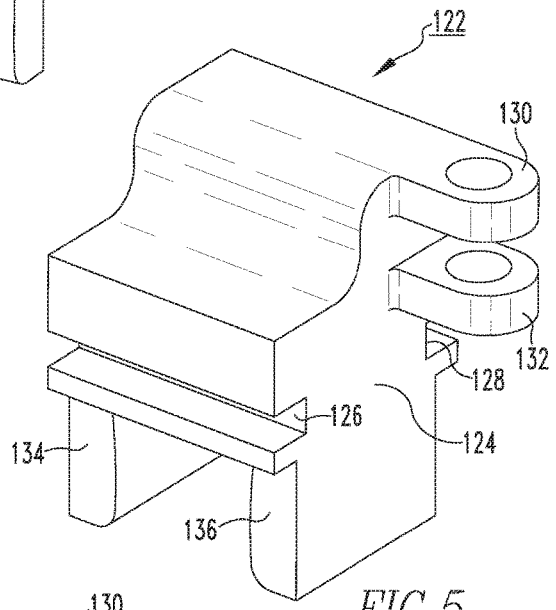
Figure 6:
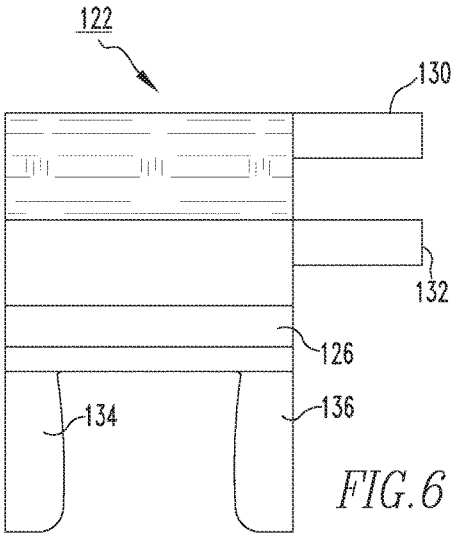
FIG. 6 is an elevation view of the driving member of FIG. 4 and FIG. 5.

FIG. 4, FIG. 5, and FIG. 6 show different views of the driving member 122. As shown, the driving member 122 has a center portion 124, a number of elongated grooved portions 126,128 each extending from the center portion 124 away from one another, a number of coupling portions 130,132 spaced from one another, and a number of driving walls 134,136 spaced from and parallel to each other. The driving walls 134,136 each extend from the center portion 124 and extend from proximate the first grooved portion 126 to proximate the second grooved portion 128.

Figure 7:
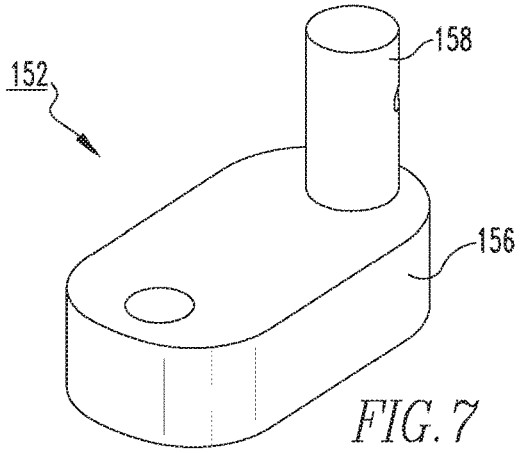
FIG. 7 is an isometric view of a rotary member for the transfer assembly of FIG. 1.

FIG. 7 shows an isometric view of the rotary member 152. As shown, the rotary member 152 has a base portion 156 and a cylindrical-shaped coupling portion 158 extending from and being generally perpendicular to the base portion 156. It will be appreciated with reference to FIG. 1 that the coupling portion 158 (not shown in FIG. 1, but see FIG. 7) extends through the third wall 108 of the body 102 and into the connector member 154 in order to be coupled to the body 102 and the connector member 154. As such, rotation of the handle member 58 (i.e., by an operator) causes rotation of the rotary member 152 via the connection between the coupling portion 158 and the connector member 154.

Referring again to FIG. 1, the coupling member 144 extends through the coupling portions 130,132 and the link member 142 in order to pivotably couple the link member 142 to the driving member 122. The coupling member 146 extends through the base portion 156 and the link member 142 in order to pivotably couple the link member 142 to the rotary member 152. In this manner, the link member 142 couples the driving member 122 to the rotary member 152.

Continuing to refer to FIG. 1, the cam assembly 120 is structured to move between a FIRST position and a SECOND position. When the cam assembly 120 moves between the FIRST position and the SECOND position, the driving member 122 drives the circuit breaker 52 between the ON position and the OFF position. More specifically, rotation of the handle member 58 (i.e., when an operator rotates the handle member 58 between a THIRD position and a FOURTH position to move the cam assembly 120 between the FIRST position and the SECOND position) causes rotation of the rotary member 152, which in turn causes the link member 142 to push or pull the driving member 122. Additionally, the circuit breaker 52 has an operating handle 54. When the cam assembly 120 moves between the FIRST position and the SECOND position, the driving member 122 slides within the body 102 and the driving walls 134,136 push the operating handle 54 in order to move the circuit breaker 52 between positions. Furthermore, when the cam assembly 120 moves between the FIRST position and the SECOND position, each of the grooved portions 126,128 slides on corresponding one of the guide rail portions 110,112. As such, by employing two opposing guide rail portions 110,112 and two opposing grooved portions 126, 128, the driving member 122 is well maintained on the body 102.

Figure 8:
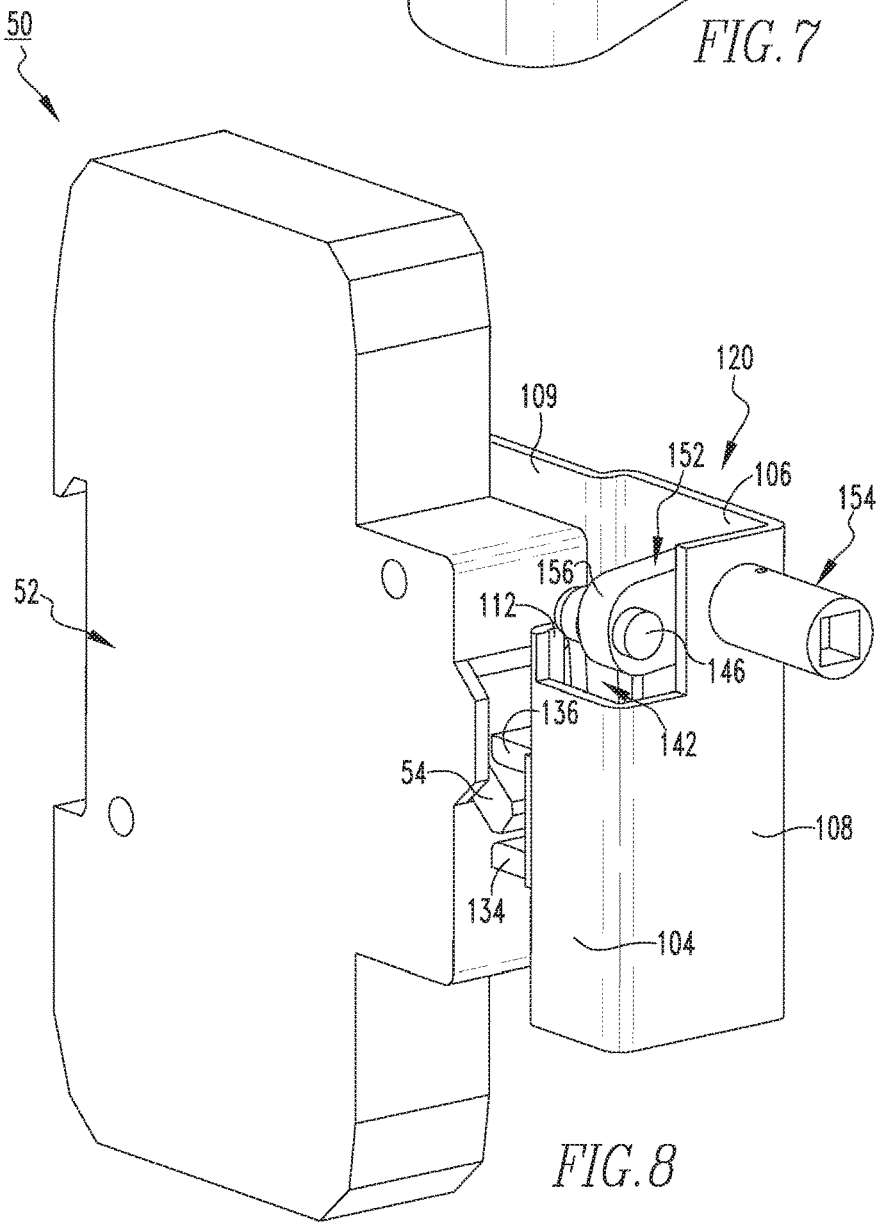
FIG. 8 is an isometric view of a portion of the switching assembly and transfer assembly therefor of FIG. 1, shown without the shaft and handle member, and shown with the electrical switching apparatus in an OFF position.

FIG. 8 shows a portion of the switching assembly 50, corresponding to the cam assembly 120 being in the SECOND position and the circuit breaker 52 being in the OFF position. As shown, the operating handle 54, which is located between the driving walls 134,136, has been driven (i.e., pushed) by the driving wall 136. Accordingly, the switching assembly 50 advantageously provides a mechanism to move the circuit breaker 52 between ON and OFF positions without requiring a wall member (e.g., without limitation, wall member 14 in FIG. 1) to be opened.

Although the disclosed concept has been described herein in association with one-pole miniature circuit breaker 52, it will be appreciated that a similar suitable alternative transfer assembly (not shown) may be employed with any suitable alternative circuit breaker (e.g., without limitation, two, three, and four-pole miniature circuit breakers, not shown), without departing from the scope of the disclosed concept. Additionally, although the disclosed concept has been disclosed in association with the transfer assembly 100 being employed to move the circuit breaker 52 between positions, it will be appreciated that suitable alternative transfer assemblies (not shown) including suitable alternative structures and/or configurations (i.e., besides the body 102, cam assembly 120, and connector member 154) are contemplated by the disclosed concept. Moreover, it will be appreciated that the disclosed transfer assembly 100 is relatively compact in design in order to minimize its overall footprint within the electrical enclosure 2 (FIG. 1). That is, by locating the driving member 122, link member 142, and rotary member 152 within body 102, the space occupied by transfer assembly 100 within electrical enclosure 2 (FIG. 1) is relatively small. Furthermore, the disclosed concept may be employed with electrical switching apparatus mounted at any depth within an electrical enclosure. More specifically, by varying the length of a shaft (e.g., shaft 56 in FIG. 1), electrical switching apparatus (e.g., circuit breaker 52) can be mounted at different depths with respect to a front panel (e.g., wall member 14 in FIG. 1).

Accordingly, the disclosed concept provides for an improved (e.g., without limitation, easier to manually move between positions) electrical enclosure 2, and switching assembly 50 and transfer assembly 100 therefor, in which a handle member 58 can remotely operate an electrical switching apparatus 52. More specifically, the handle member 58, which is located external an enclosed region defined by a number of wall members 4,6,8,10,12,14, is able to move the electrical switching apparatus 52 and transfer assembly 100, which are located internal the enclosed region and coupled to the wall member 12, between positions.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A transfer assembly for a switching assembly of an electrical enclosure, said switching assembly comprising an electrical switching apparatus, a shaft, and a handle member coupled to said shaft, said electrical switching apparatus being structured to move between an ON position and an OFF position, said transfer assembly comprising:

a body structured to be coupled to said electrical switching apparatus; and a cam assembly structured to move between a FIRST position and a SECOND position, said cam assembly comprising:

a rotary member coupled to said body and structured to be coupled to said shaft, and a driving member cooperable with said rotary member, wherein, when said cam assembly moves between the FIRST position and the SECOND position, said driving member drives said electrical switching apparatus between the ON position and the OFF position; wherein, when said cam assembly moves between the FIRST position and the SECOND position, said driving member slides within said body; wherein said body comprises a first wall, a second wall, a third wall connecting the first wall to the second wall, and a guide rail portion extending from the second wall toward the first wall; wherein said driving member comprises a center portion and a grooved portion extending from the center portion; and wherein, when said cam assembly moves between the FIRST position and the SECOND position, the grooved portion slides on the guide rail portion.

2. The transfer assembly of claim 1 wherein said body further comprises another guide rail portion extending from the first wall toward the second wall; wherein said driving member further comprises another grooved portion extending from the center portion away from the grooved portion; and wherein, when said cam assembly moves between the FIRST position and the SECOND position, the another grooved portion slides on the another guide rail portion.

3. The transfer assembly of claim 1 wherein the third wall is disposed perpendicular to the first wall and the second wall.

4. A transfer assembly for a switching assembly of an electrical enclosure, said switching assembly comprising an electrical switching apparatus, a shaft, and a handle member coupled to said shaft, said electrical switching apparatus being structured to move between an ON position and an OFF position, said transfer assembly comprising:

a body structured to be coupled to said electrical switching apparatus; and a cam assembly structured to move between a FIRST position and a SECOND position, said cam assembly comprising:

a rotary member coupled to said body and structured to be coupled to said shaft, and a driving member cooperable with said rotary member, wherein, when said cam assembly moves between the FIRST position and the SECOND position, said driving member drives said electrical switching apparatus between the ON position and the OFF position; wherein said cam assembly further comprises a link member coupling said rotary member to said driving member; wherein said driving member comprises a first coupling portion and a second coupling portion spaced from the first coupling portion; and wherein said transfer assembly further comprises a coupling member extending through the first coupling portion, the second coupling portion, and said link member in order to couple said link member to said driving member.

5. The transfer assembly of claim 4 wherein, when said cam assembly moves between the FIRST position and the SECOND position, said driving member slides within said body.

6. The transfer assembly of claim 4 wherein said driving member further comprises a center portion, a first grooved portion extending from the center portion, and a second grooved portion extending from the center portion; and wherein the first grooved portion and the second grooved portion are disposed on opposing sides of the center portion.

7. The transfer assembly of claim 6 wherein said driving member further comprises a first driving wall and a second driving wall spaced from and parallel to said first driving wall; wherein said first driving wall and said second driving wall each extend from the center portion; and wherein said first driving wall and said second driving wall each extend from proximate the first grooved portion to proximate the second grooved portion.

8. A switching assembly for an electrical enclosure, said switching assembly comprising:

an electrical switching apparatus structured to move between an ON position and an OFF position;

a shaft;

a handle member coupled to said shaft; and a transfer assembly comprising:

a body coupled to said electrical switching apparatus, and a cam assembly structured to move between a FIRST position and a SECOND position, said cam assembly comprising:

a rotary member coupled to said body and said shaft, and a driving member cooperable with said rotary member, wherein, when said cam assembly moves between the FIRST position and the SECOND position, said driving member drives said electrical switching apparatus between the ON position and the OFF position; wherein said driving member comprises a center portion, a first driving wall extending from the center portion, and a second driving wall extending from the center portion; wherein the first driving wall and the second driving wall are spaced from and parallel to each other; and wherein said electrical switching apparatus comprises an operating handle disposed between said first driving wall and said second driving wall.

9. A switching assembly for an electrical enclosure, said switching assembly comprising:

an electrical switching apparatus structured to move between an ON position and an OFF position;

a shaft;

a handle member coupled to said shaft; and a transfer assembly comprising:

a body coupled to said electrical switching apparatus, and a cam assembly structured to move between a FIRST position and a SECOND position, said cam assembly comprising:

a rotary member coupled to said body and said shaft, and a driving member cooperable with said rotary member, wherein, when said cam assembly moves between the FIRST position and the SECOND position, said driving member drives said electrical switching apparatus between the ON position and the OFF position; wherein said transfer assembly further comprises a cylindrical-shaped connector member disposed on said body; and wherein said rotary member and said shaft extend into and are coupled to said connector member.

10. A switching assembly for an electrical enclosure, said switching assembly comprising:

an electrical switching apparatus structured to move between an ON position and an OFF position;

a shaft;

a handle member coupled to said shaft; and a transfer assembly comprising:

a body coupled to said electrical switching apparatus, and a cam assembly structured to move between a FIRST position and a SECOND position, said cam assembly comprising:

a rotary member coupled to said body and said shaft, and a driving member cooperable with said rotary member, wherein, when said cam assembly moves between the FIRST position and the SECOND position, said driving member drives said electrical switching apparatus between the ON position and the OFF position; wherein said handle member is structured to rotate between a THIRD position and a FOURTH position; and wherein, responsive to said handle member rotating between the THIRD position and the FOURTH position, said cam assembly moves between the FIRST position and the SECOND position.

11. The switching assembly of claim 10 wherein said cam assembly further comprises a link member coupling said rotary member to said driving member.

12. The switching assembly of claim 11 wherein said driving member comprises a first coupling portion and a second coupling portion spaced from the first coupling portion; and wherein said transfer assembly further comprises a coupling member extending through the first coupling portion, the second coupling portion, and said link member in order to couple said link member to said driving member.

13. The switching assembly of claim 10 wherein, when said cam assembly moves between the FIRST position and the SECOND position, said driving member slides within said body.

14. The switching assembly of claim 13 wherein said body comprises a first wall, a second wall, a third wall connecting the first wall to the second wall, and a guide rail portion extending from the second wall toward the first wall; wherein said driving member comprises a center portion and a grooved portion extending from the center portion; and wherein, when said cam assembly moves between the FIRST position and the SECOND position, the grooved portion slides on the guide rail portion.

15. The switching assembly of claim 14 wherein the third wall is disposed perpendicular to the first wall and the second wall.

16. An electrical enclosure comprising:

a number of walls defining an enclosed region; and a switching assembly comprising:

an electrical switching apparatus structured to move between an ON position and an OFF position, said electrical switching apparatus being coupled to at least one of said number of walls, a shaft, a handle member coupled to said shaft, and a transfer assembly comprising:

a body coupled to said electrical switching apparatus, and a cam assembly structured to move between a FIRST position and a SECOND position, said cam assembly comprising:

a rotary member coupled to said body and said shaft, and a driving member cooperable with said rotary member, wherein, when said cam assembly moves between the FIRST position and the SECOND position, said driving member drives said electrical switching apparatus between the ON position and the OFF position; wherein said handle member is structured to rotate between a THIRD position and a FOURTH position; and wherein, responsive to said handle member rotating between the THIRD position and the FOURTH position, said cam assembly moves between the FIRST position and the SECOND position.

17. The electrical enclosure of claim 16 wherein said handle member is disposed external with respect to the enclosed region; wherein said electrical switching apparatus and said transfer assembly are disposed internal with respect to the enclosed region; and wherein said shaft extends through one of said number of walls.

* * * * *